US012280981B2

(12) United States Patent
Edstrom

(10) Patent No.: US 12,280,981 B2
(45) Date of Patent: Apr. 22, 2025

(54) AUTOMATED FILAMENT SPOOLER

(71) Applicant: WINDAK HOLDING AB, Järfälla (SE)

(72) Inventor: Staffan Edstrom, Castle Hill (AU)

(73) Assignee: WINDAK HOLDING AB, Järfälla (SE)

( * ) Notice: Subject to any disclaimer, the term of this patent is extended or adjusted under 35 U.S.C. 154(b) by 824 days.

(21) Appl. No.: 17/489,208

(22) Filed: Sep. 29, 2021

(65) Prior Publication Data

US 2023/0101194 A1 Mar. 30, 2023

(51) Int. Cl.

| | |
|---|---|
| ***B65H 54/22*** | (2006.01) |
| ***B65H 54/42*** | (2006.01) |
| ***B65H 65/00*** | (2006.01) |
| ***B65H 67/04*** | (2006.01) |
| ***B65H 75/28*** | (2006.01) |
| *B65B 27/06* | (2006.01) |

(52) U.S. Cl.

CPC ..... *B65H 54/22* (2013.01); *B65H 54/42* (2013.01); *B65H 65/00* (2013.01); *B65H 67/04* (2013.01); *B65H 75/285* (2013.01); *B65B 27/06* (2013.01); *B65H 2403/10* (2013.01)

(58) Field of Classification Search

CPC ..... B65H 75/28; B65H 67/0411; B65H 67/0417; B65H 2403/10; B65H 27/06; B65H 54/22; B65H 67/04; B65H 67/0422; B65H 65/00

See application file for complete search history.

(56) References Cited

U.S. PATENT DOCUMENTS

| | | | | |
|---|---|---|---|---|
| 3,941,329 A * | 3/1976 | Maillefer | ..... | B65H 65/00 242/488 |
| 4,034,933 A * | 7/1977 | Hara | ..... | B65H 75/08 242/125.3 |
| 4,610,404 A * | 9/1986 | Maccaferri | ..... | B65H 67/04 242/473.7 |
| 4,883,230 A * | 11/1989 | Lindstrom | ..... | B65H 65/00 174/DIG. 13 |

(Continued)

FOREIGN PATENT DOCUMENTS

| | | | | |
|---|---|---|---|---|
| DE | 4010579 A1 * | 10/1991 | ..... | B65H 18/00 |
| EP | 0202591 B1 * | 7/1990 | ..... | B65H 19/28 |

*Primary Examiner* — Sang K Kim
*Assistant Examiner* — Nathaniel L Adams
(74) *Attorney, Agent, or Firm* — CHRISTOPHER C. DREMANN, P.C.; Christopher C. Dremann

(57) ABSTRACT

An automated filament spooler for winding and optionally packaging a filament includes an enclosure, a conveyor for conveying an empty spool into the enclosure and for conveying a wound spool from the enclosure, an indexing unit for positioning a feeding hole on the spool at a location for feeding a free end of the filament onto the spool, a filament feeding unit for feeding the free end of the filament through the feeding hole on the spool, a spooling unit for gripping the free end of the filament and rotating the spool to wind the filament onto the spool, and an optional packaging unit for applying a stretch wrap to the wound spool. A method for automatically winding a filament onto a spool includes positioning the feeding hole, feeding the free end of the filament onto the spool, gripping the free end of the filament and rotating the spool.

20 Claims, 8 Drawing Sheets

(56) References Cited

U.S. PATENT DOCUMENTS

| | | | | | |
|---|---|---|---|---|---|
| 5,460,333 | A | * | 10/1995 | Vanhuyse | B65H 75/28 242/476.6 |
| 6,012,668 | A | * | 1/2000 | Zurfluh | B65H 54/36 242/399.1 |
| 2017/0233215 | A1 | | 8/2017 | Lasswell et al. | |
| 2019/0344992 | A1 | * | 11/2019 | Innilä | G02B 6/4457 |
| 2020/0001519 | A1 | | 1/2020 | Tanigawa et al. | |
| 2020/0062533 | A1 | | 2/2020 | Lasswell et al. | |
| 2020/0307947 | A1 | | 10/2020 | Tanigawa et al. | |

* cited by examiner

AUTOMATED FILAMENT SPOOLER

FIELD OF THE INVENTION

The present invention relates generally to winding and packaging equipment for elongate, flexible material. More particularly, the invention is an automated spooler for winding and packaging three-dimensional (3D) printing filament.

BACKGROUND OF THE INVENTION

A spool, reel, hub and the like, collectively referred to herein as a spool, is commonly utilized for receiving, storing and dispensing a length of an elongate, relatively thin or small diameter, flexible material, such as filament. Filament is wound onto the spool, for example in a three-dimensional (3D) printing filament extrusion production, and stored on the spool, for example while being inventoried and during transport. In many instances, the spool of filament is provided with exterior packaging, such as stretch wrap material, to protect the filament during storage and transport. The stretch wrap material is subsequently removed and the filament is unwound from the spool, for example, to be used in three-dimensional (3D) printing.

Until now, existing spoolers for winding and packaging 3D printing filament have been manual winders. Specifically, existing spoolers for winding and packaging 3D printing filament on a spool require manual loading of the empty spool onto the winder, manual attachment of the filament to the empty spool, manual unloading of the spool of wound filament from the winder, and manual wrapping of packaging material, such as stretch wrap, onto the spool of wound filament. Such manual operations reduce the accuracy, speed and efficiency of the winding and packaging processes, thereby unnecessarily increasing the manpower requirements and cost of 3D printing filament extrusion production.

In view of the aforementioned problems, deficiencies and drawbacks, it is apparent that improved winding and packaging equipment for elongate, flexible material is needed. A particular need exists for an automated filament spooler for winding and packaging 3D printing filament. Such an automated filament spooler would necessarily increase the accuracy, speed and efficiency of the winding and packaging processes, thereby reducing the manpower requirements and cost of 3D printing filament extrusion production.

SUMMARY OF THE INVENTION

The present invention addresses the problems, deficiencies and drawbacks associated with existing winding and packaging equipment for elongate, flexible material. In particular, the present invention provides an improvement over manual spoolers for winding and packaging three-dimensional (3D) printing filament. In an advantageous embodiment, the invention is an automated filament spooler for winding and packaging 3D printing filament in 3D printing filament extrusion production.

In one aspect, the invention is embodied by an automated filament spooler for automatically winding a filament on a spool. The automated filament spooler includes an enclosure and a conveyor for conveying an empty spool into the enclosure and for conveying a wound spool from the enclosure. The automated filament spooler further includes an indexing unit configured and operable for automatically positioning a feeding hole provided on the spool at a location necessary for feeding a free end of the filament onto the spool. The automated filament spooler further includes a filament feeding unit configured and operable for automatically feeding the free end of the filament through the feeding hole of the spool. The automated filament spooler further includes a spooling unit configured and operable for automatically gripping the free end of the filament and for rotating the spool to wind the filament onto the spool.

In one embodiment, the indexing unit includes at least one roller for rotating the spool on the indexing unit, wherein the at least one roller has at least one groove for receiving an outer flange of the spool.

In another embodiment, the filament feeding unit is disposed above the indexing unit with the feeding hole positioned at the location necessary for feeding the free end of the filament onto the spool. The filament feeding unit includes a filament feeder that is moved downwardly in a vertical direction from a retracted position to an extended position for feeding the free end of the filament onto the spool. The filament feeder includes a cam plate and an associated cam that guide and position a feeding tube above the feeding hole provided on the spool. The feeding tube is operable for feeding the free end of the filament into a barrel of the spool through the feeding hole.

In another embodiment, the spooling unit includes a filament end attachment clamp configured and operable for gripping the free end of the filament within a barrel of the spool during a winding process to retain the filament on the spool. The filament end attachment clamp includes a pair of pins disposed inside the barrel of the spool that close together to thereby grip the free end of the filament within the barrel of the spool. The spooling unit further includes a spool drive flange that is operable for transferring rotational movement to the spool during a winding process. The spool drive flange has a covering that provides increased friction between the spool drive flange and the spool during the winding process. The spool drive flange is movable in an axial direction and biased by a biasing element such that when the spool is loaded into the spooling unit an outer flange of the spool presses against the spool drive flange and the biasing element is compressed behind the spool drive flange. The filament end attachment clamp protrudes outwardly in the axial direction from the spool drive flange to grip the free end of the filament within the barrel of the spool, and a biasing force exerted by the biasing element of the spool drive flange serves to push the spool off the filament end attachment clamp in the axial direction so that the spool is free to move downwardly in a vertical direction onto the conveyor to be conveyed from the enclosure.

In another embodiment, the automated filament spooler further includes a packaging unit configured and operable for packaging a spool of the filament. Preferably, the packaging unit is a stretch wrap applicator including a clamp having a cutting blade that is movable between an opened position and a closed position, and the clamp rotates around the spool to cover the spool with a first layer of a stretch wrap. The stretch wrap applicator includes a cam plate having a cam profile that controls when the clamp is in the opened position and when the clamp is in the closed position such that a clamp plate of the clamp is pressed against a stop with the stretch wrap disposed between the clamp plate and the stop.

In another aspect, the invention is embodied by a method for automatically winding a filament onto a spool. The method includes conveying the spool into an enclosure of an automated filament spooler. The method further includes automatically positioning a feeding hole provided on the spool at a location necessary for feeding the filament onto the spool. The method further includes automatically feeding a free end of the filament onto the spool through the feeding hole provided on the spool. The method further includes automatically gripping the free end of the filament fed through the feeding hole provided on the spool. The method further includes rotating the spool to wind a length of the filament onto the spool.

In one embodiment, the method further includes automatically cutting the length of the filament wound onto the spool.

In another embodiment, the method further includes automatically packaging the spool with a shrink wrap.

In another embodiment, positioning the feeding hole provided on the spool includes rotating the spool on at least one roller having at least one groove for receiving an outer flange of the spool to limit a movement of the spool on the automated filament spooler in an axial direction.

DETAILED DESCRIPTION OF EXEMPLARY EMBODIMENTS OF THE INVENTION

Figure 1:
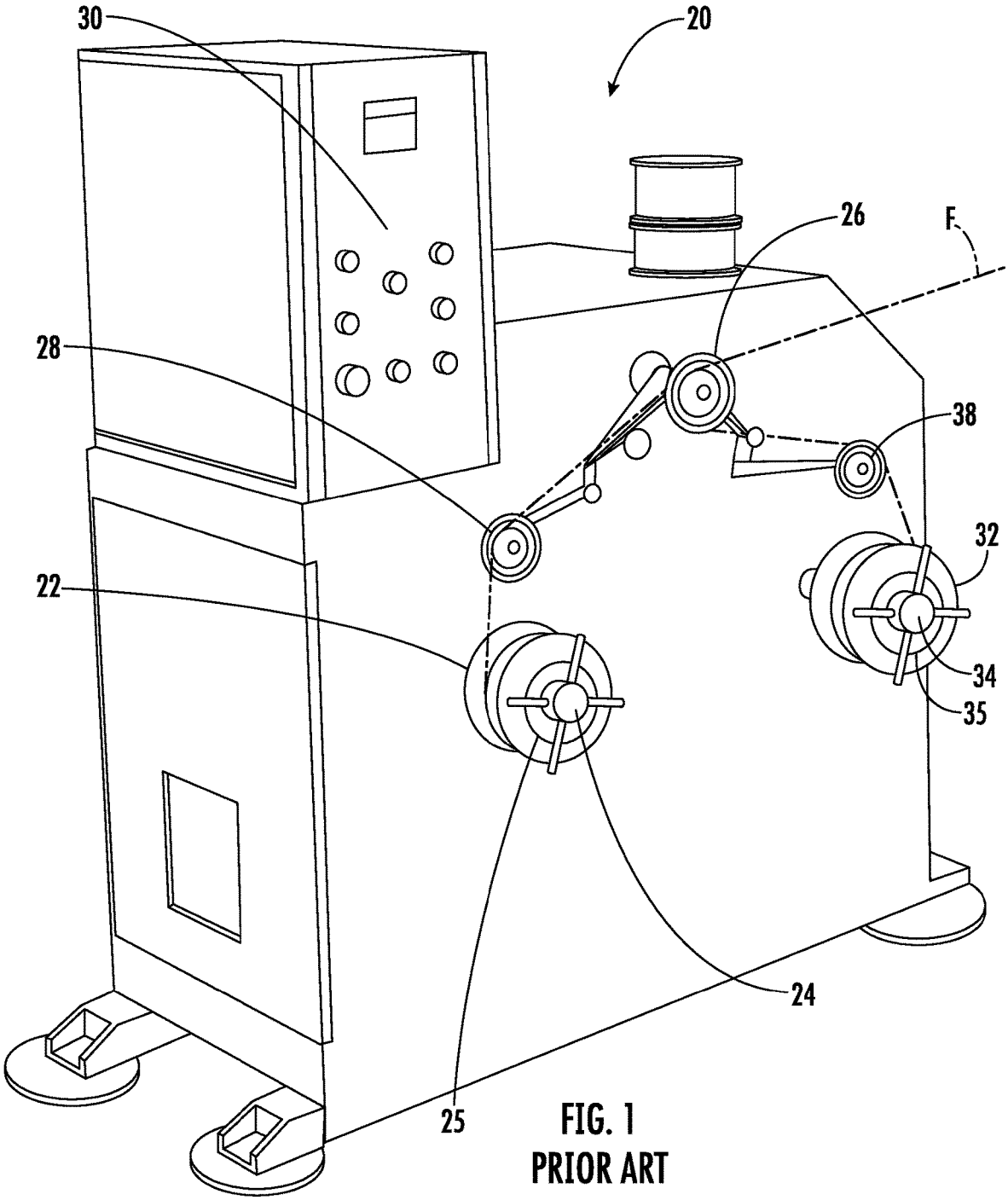
FIG. 1 PRIOR ART
FIG. 1 is a perspective view showing an existing manual filament spooler for winding filament onto a spool.

Referring now to the accompanying drawings, in which like reference characters in the various drawing figures refer generally to the same or similar parts, FIG. 1 shows an existing manual filament spooler, while FIGS. 2-13 show exemplary embodiments of an automated filament spooler according to the invention. As used herein, the term "filament" refers generically to an elongate, relatively thin or small diameter, flexible material configured for winding onto a spool, reel, hub, or the like, collectively referred to herein as a spool. In the exemplary embodiments described and shown herein, the filament is preferably a plastic material used in three-dimensional (3D) printing, commonly referred to as three-dimensional (3D) printing filament. The 3D printing filament is typically wound onto a spool in filament extrusion production, and optionally may be packaged with a stretch wrap material for storage and transport until the filament is subsequently unwound from the spool for use in 3D printing. Those having ordinary skill in the art will readily understand and appreciate that the spool is manufactured independent of the filament, except that the construction of the spool, including without limitation the materials, dimensions, geometry, reinforcement elements, etc. of the spool may be influenced by the type of filament to be wound onto the spool. Furthermore, the automated filament spooler of the present invention may be utilized with other elongate, flexible materials and other types of filaments, and in various other applications without departing from the intended broad scope of the invention and this disclosure.

The exemplary embodiments of an automated filament spooler shown and described herein are configured for use with filament material, including by way of example and without limitation, 3D printing filament, having any desired cross-sectional shape (e.g., round, square, rectangular) or size. Regardless, it is intended that the appended claims be construed to encompass an automated filament spooler configured for automatically winding and packaging elongate, relatively thin or small diameter, flexible material onto spools, reels, hubs and the like, as well as other suitable articles of manufacture, without unreasonable exception.

FIG. 1 shows an existing manual filament spooler, indicated generally at 20, for winding filament F onto a spool. The manual filament spooler 20 shown in FIG. 1 is standalone winding equipment that is not configured for use in an in-line production process, such as 3D printing filament extrusion production. Consequently, an operator must manually place a first spool 22 over a first spooling shaft 24 of a first spooling head (not shown) of the manual filament spooler 20 and manually secure the first spool 22 on the first spooling shaft 24 with a first locking collar 25. The operator must next manually feed a free end of the filament F over a transfer wheel 26 and a first laying wheel 28 and manually secure the free end of the filament F onto the first spool 22. The manual filament spooler 20 further comprises a control panel 30 including at least a processor and electronics (not shown) for controlling operation of the electromechanical components of the manual filament spooler 20. In particular, the control panel 30 permits an operator to activate the first spooling shaft 24 to rotate the first spooling head and the first spool 22 to thereby cause a length of the filament F to be wound onto the first spool 22. Once the filament F has been wound onto the first spool 22, the operator manually cuts the filament F, secures the cut end of the filament F to the first spool 22, unlocks the first locking collar 25 and removes the first spool 22 from the first spooling shaft 24 of the first spooling head.

While the filament F is wound onto the first spool 22, the operator may manually place a second spool 32 onto a second spooling shaft 34 of a second spooling head (not shown) and secure the second spool 32 on the second spooling shaft 34 with a second locking collar 35. In this manner, the operator can immediately manually thread the free end of the filament F (i.e. the end of the filament F cut from the first spool 22) over the transfer wheel 26 and a second laying wheel 38 and manually secure the free end of the filament F onto the second spool 32 once the first spool 22 is wound and the filament F is cut. The operator can then use the control panel 30 to activate the second spooling shaft 34 to rotate the second spooling head and the second spool 32 to thereby cause a length of the filament F to be wound onto the second spool 32. Once the filament F has been wound into the second spool 32, the operator can manually cut the filament F, secure the cut end of the filament F to the second spool 32, unlock the second locking collar 35 and remove the second spool 32 from the second spooling shaft 34 of the second spooling head. The foregoing process can be repeated by with another first spool 22 and another second spool 32 alternating between the first spooling shaft 24 of the first spooling head and the second spooling shaft 34 of the second spooling head, respectively, to produce a desired number of spools wound with the filament F. If desired, the spools wound with filament F optionally may be packaged, for example in a container or with a shrink wrap material, such as shrink wrap film, in a subsequent process using packaging equipment that is separate from the manual filament spooler 20.

Figure 2:
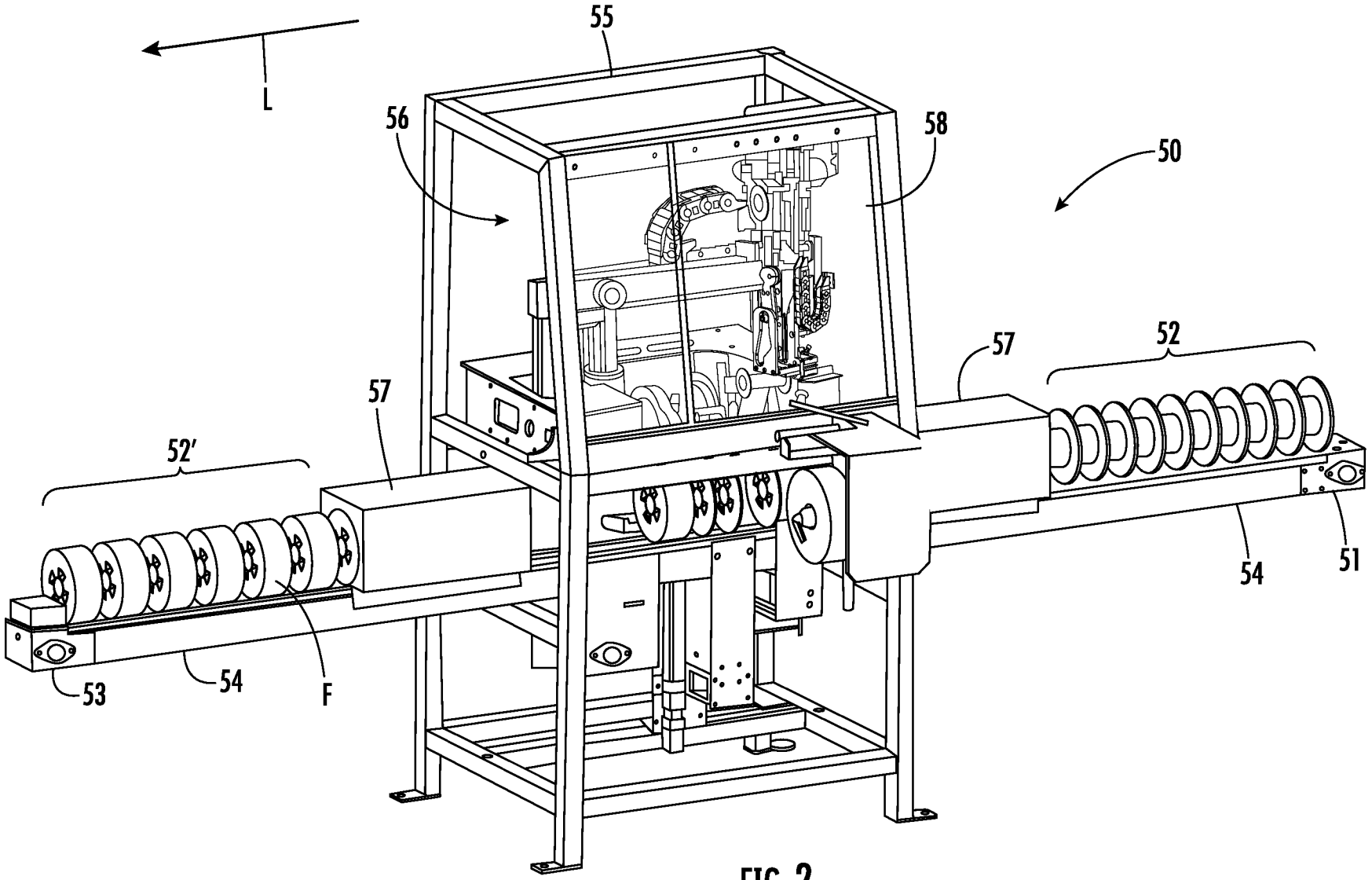
FIG. 2 is a perspective view of an automated filament spooler according to an exemplary embodiment of the invention.
Figure 3:
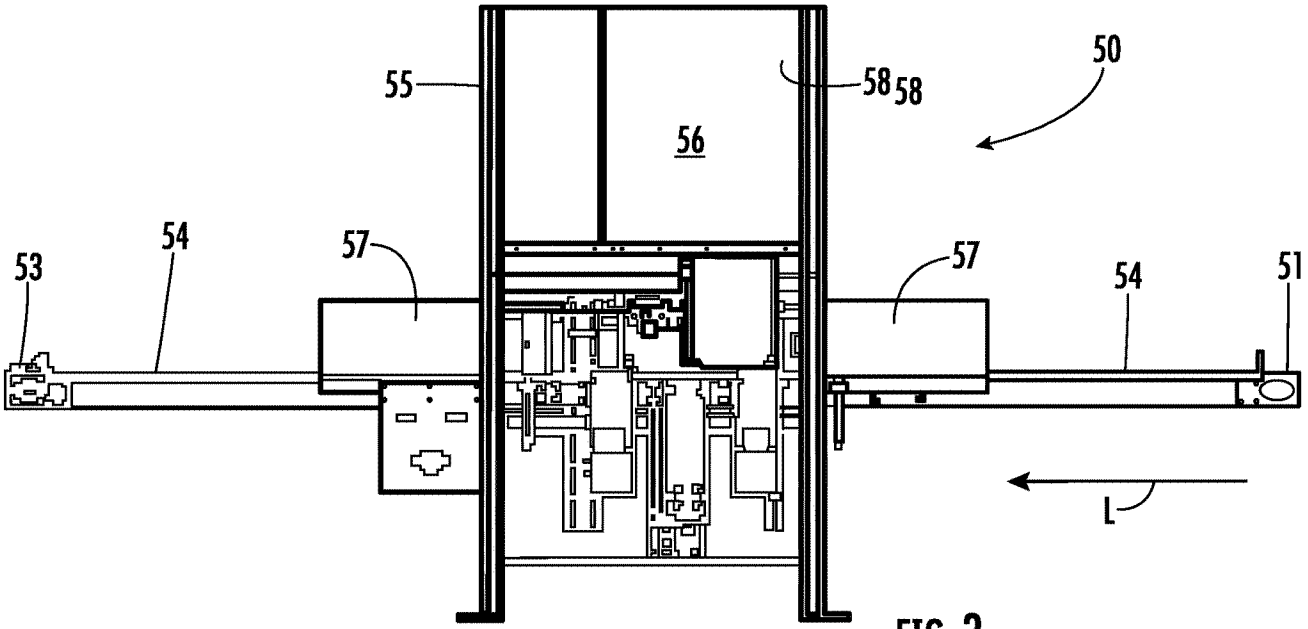
FIG. 3 is a front elevation view of the automated filament spooler of FIG. 2.
Figure 4:
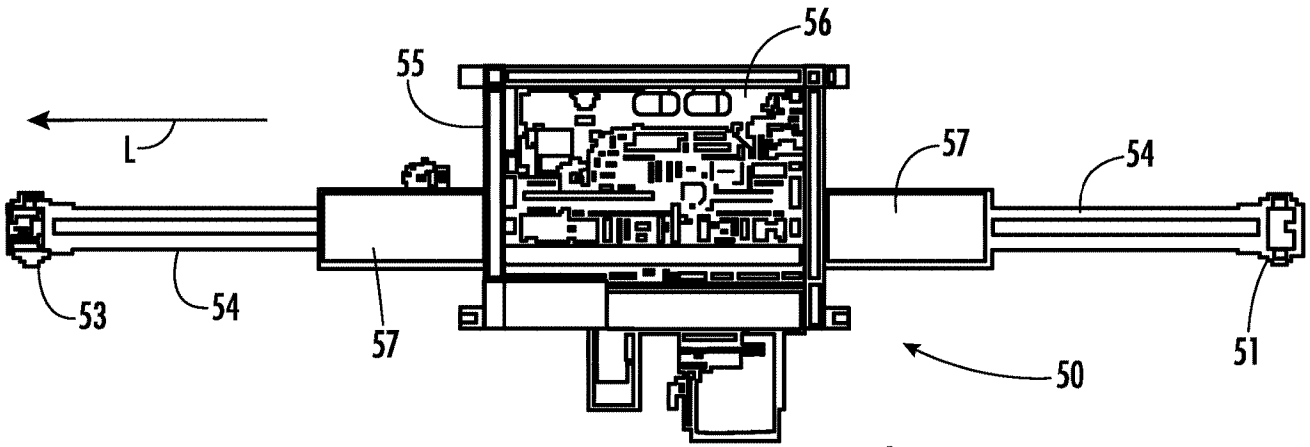
FIG. 4 is a top plan view of the automated filament spooler of FIG. 2.

FIGS. 2-13 show an automated filament spooler, indicated generally at 50, according to an exemplary embodiment of the present invention. For purposes of illustration, the perspective view of FIG. 2 shows a plurality of empty spools 52 configured for having an elongate flexible material, such as a filament F, wound thereon by the automated filament spooler 50, and a plurality of wound spools 52' having the filament F wound thereon by the automated filament spooler 50. FIG. 3 is a front elevation view of the automated filament spooler 50 and FIG. 4 is a top plan view of the automated filament spooler 50. Empty spools 52 and wound spools 52' are not shown in FIG. 3 or FIG. 4 for purposes of clarity.

In FIG. 2, the automated filament spooler 50 is viewed from the front, or operating, side of the spooler 50. The empty spools 52 are loaded by an operator onto a conveyor 54 that extends along the automated filament spooler 50 in a lengthwise direction L between an intake side 51 and an outtake side 53 of the spooler 50. As depicted in FIG. 2, the empty spools 52 are loaded onto the conveyor from the intake side 51 at the right-hand end of the spooler 50. However, the empty spools 52 may be loaded onto the conveyor 54 from either the right-hand end or the left-hand end, or from any desired direction (e.g. perpendicular to the lengthwise direction L) in other embodiments. In any event the wound spools 52' are conveyed on conveyor 54 from the automated filament spooler 50 to the outtake side 53 and are removed by an operator following the winding and optional packaging processes, as will be described hereafter. Importantly, the empty spools 52 are conveyed on conveyor 54 into the automated filament spooler 50 and from the spooler 50 automatically. Consequently, an operator is not required to manually load an empty spool 52 onto a spooling head or to manually remove a wound spool 52' from a spooling head. The automated filament spooler 50 further comprises a frame 55 defining an enclosure 56 having safety covers 57 and a lockable safety sliding door 58 for limiting access to operational components of the spooler 50. As a result, automated filament spooler 50 is safer, faster, more accurate and more efficient than the existing manual filament spoolers.

Generally speaking, an empty spool 52 is conveyed on the conveyor 54 into the enclosure 56 from the intake side 51 of the automated filament spooler 50. The empty spool 52 is then indexed to position a feeding hole provided on the empty spool 52 at a filament feeding location. The properly indexed empty spool 52 is then disposed on a spooling head. Next, a laying unit automatically feeds a free end of a filament into the feeding hole of the empty spool 52 and automatically attaches the free end of the filament on the empty spool 52. The automated filament spooler 50 then automatically winds the filament onto the spool 52 and cuts the filament from the wound spool 52'.

The automated filament spooler 50 next optionally covers the filament on the wound spool 52' with packaging, and in particular stretch wrap, and then cuts the stretch wrap from the wound spool 52'. The wound spool 52' is then unloaded from the spooling head and conveyed on conveyor 54 out of the enclosure 56 on the outtake side 53 of the automated filament spooler 50. If desired, the spooler 50 may further comprise an optional automated fault detector (not shown) for detecting a possible fault in the filament and/or the wound spool 52'. In the event of a detected fault, the wound spool 52' is ejected from the conveyor 54 into a recycle bin for salvaging the filament and/or the spool. Wound spools 52' without a detected fault accumulate at the end of the conveyor 54 on the outtake side of the automated filament spooler 50 to be removed by an operator.

Figure 5:
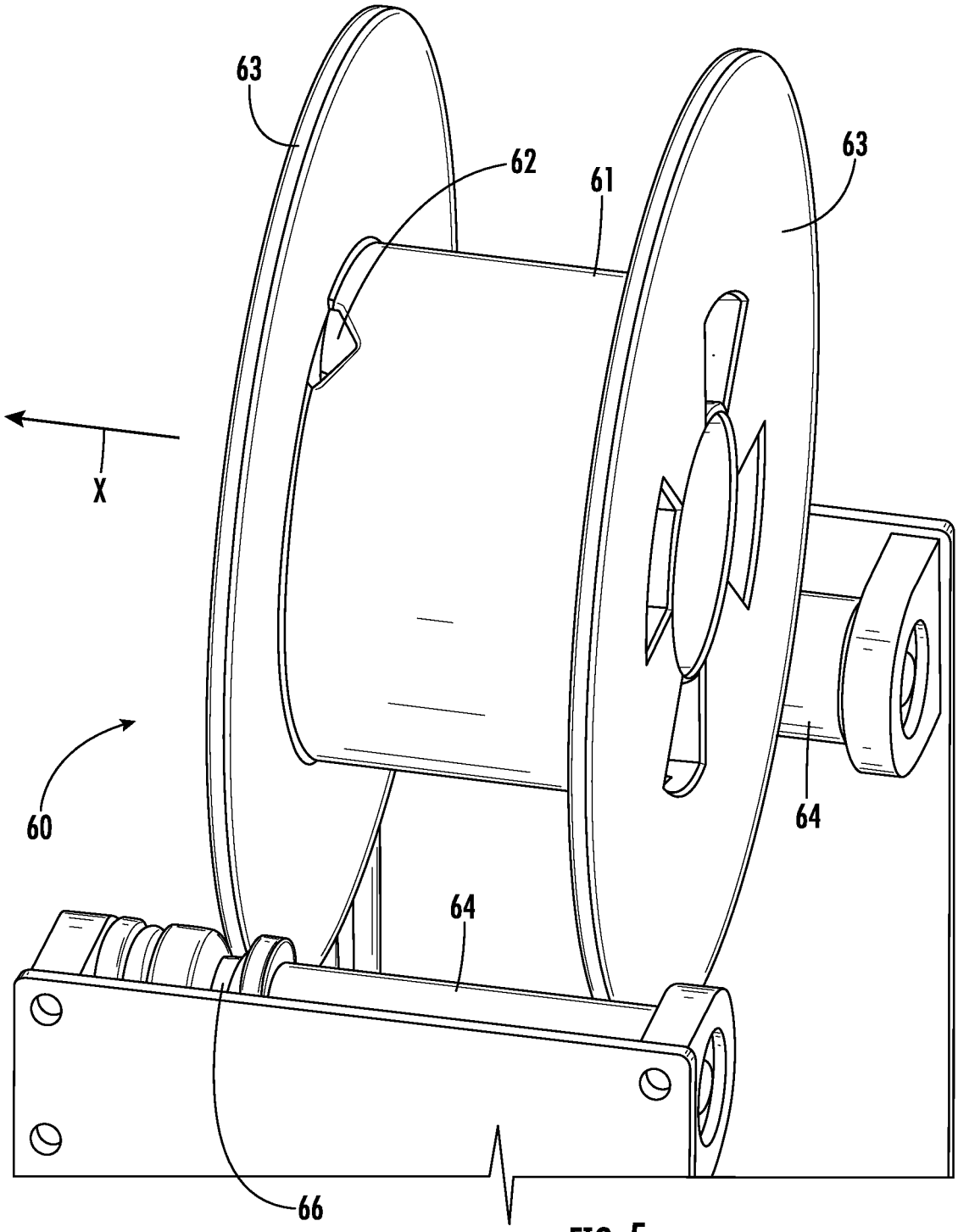
FIG. 5 is an enlarged perspective view showing an exemplary embodiment of an indexing unit of the automated filament spooler of FIG. 2.

Specific operational components of the automated filament spooler 50 will now be described in greater detail with reference to FIGS. 5-13. FIG. 5 shows an empty spool 52 conveyed into the enclosure 56 of the automated filament spooler 50 and positioned on an indexing unit 60 of the spooler 50. In an exemplary embodiment, the indexing unit 60 detects a feeding hole 62 provided on the barrel 61 between outer flanges 63 of the empty spool 52 for receiving the free end of a filament to be wound onto the spool 52. In particular, the indexing unit 60 is configured and operable for positioning the feeding hole 62 at a location necessary for feeding the free end of the filament to the empty spool 52. In a preferred embodiment, the empty spool 52 is supported on the indexing unit 60 by rollers 64 or the like. At least one, and preferably both, of the rollers 64 are rotatable so as to rotate the empty spool 52 to the desired location of the feeding hole 62.

The feeding hole 62 defines a small guide for receiving the free end of the filament relative to the width of the barrel 61 of the empty spool 52. Consequently, the empty spool 52 must be positioned precisely on the rollers 64 of the indexing unit 60. Otherwise, an indexing sensor beam (not shown) of the indexing unit 60 will not be able to detect the feeding hole 62 on the barrel 61 of the empty spool 52. At least one groove 66 is provided on at least one of the rollers 64 of the indexing unit 60 for receiving an outer flange 63 of the empty spool 52. With a flange 63 disposed within groove 66 of the indexing unit 60, the spool 52 will not move (i.e. slide) on the rollers 64 in the axial direction X when the rollers 64 rotate to position the feeding hole 62 at the location necessary for receiving the free end of the filament.

Figure 6:
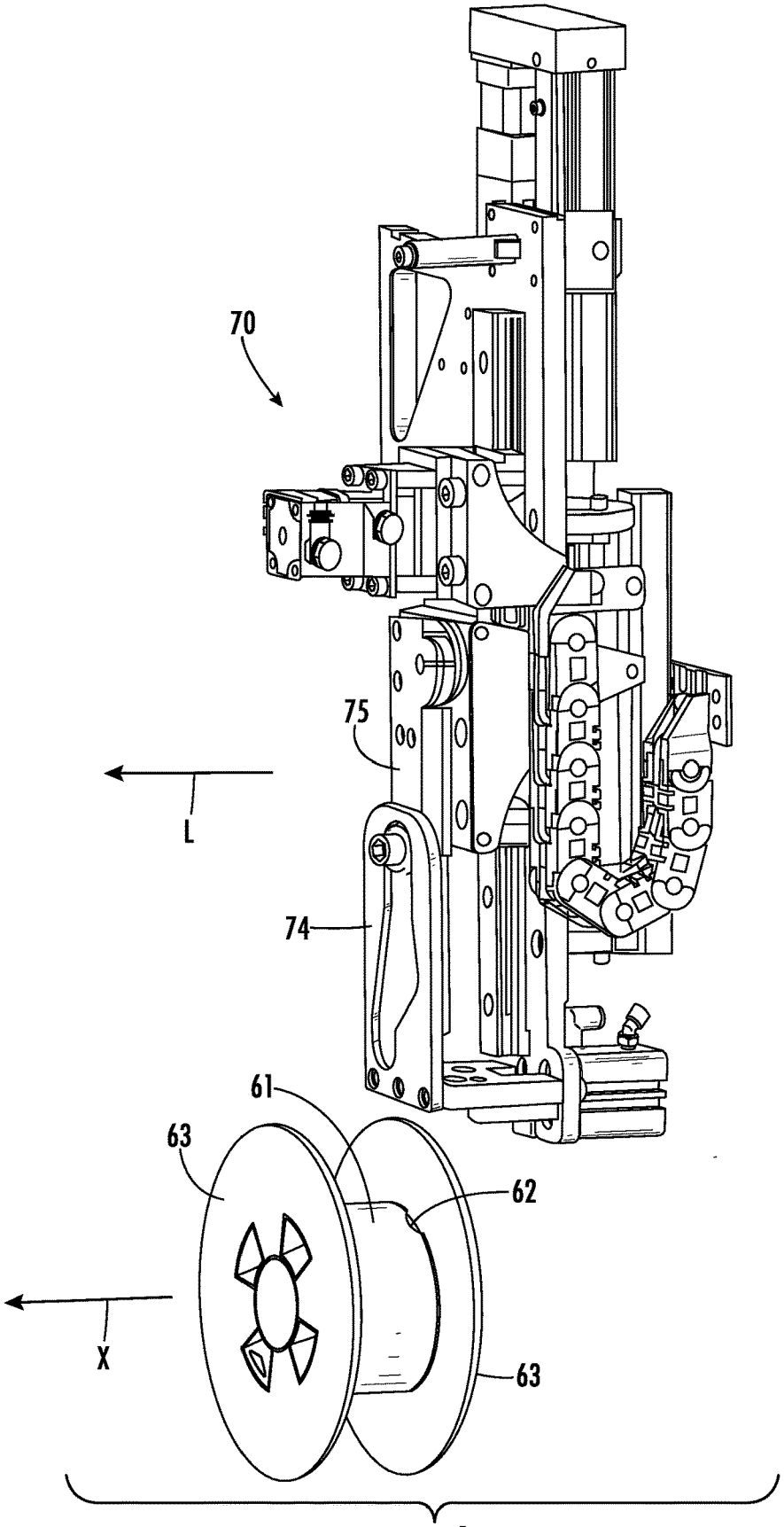
FIG. 6 is a perspective view showing an exemplary embodiment of a filament feeding unit of the automated filament spooler of FIG. 2.
Figure 8:
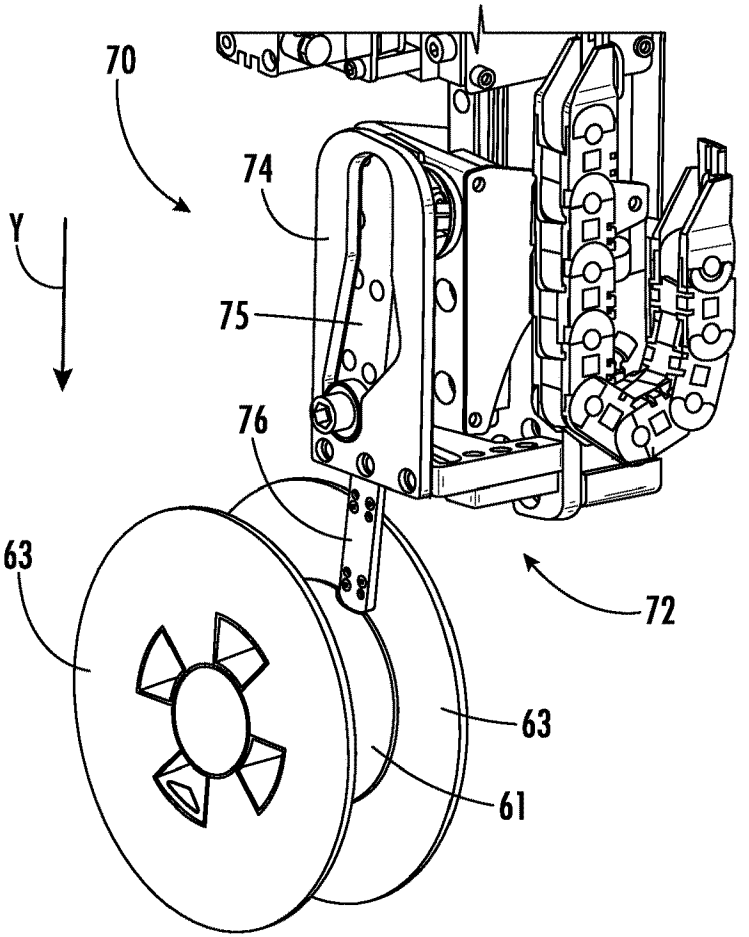
FIG. 8 is a detail perspective view showing the filament feeder of FIG. 7 in an extended position for feeding the free end of the filament to the empty spool.
Figure 7:
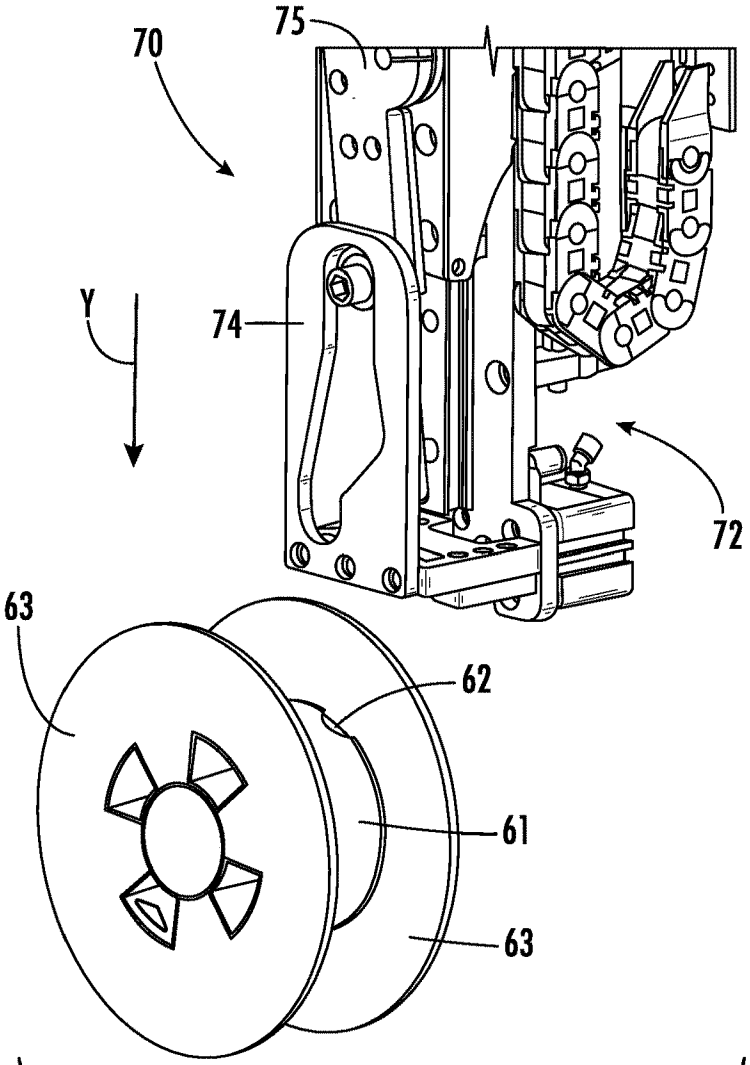
FIG. 7 is a detail perspective view showing an empty spool indexed for receiving a free end of a filament from a filament feeder of the automated filament spooler of FIG. 2.

FIGS. 6-8 show an exemplary embodiment of a filament feeding unit 70 of the automated filament spooler 50. Filament feeding unit 70 provides a filament feeding functionality. In particular, unit 70 is configured and operable for gripping the free end of the filament and for delivering (i.e. pulling) the free end of the filament downwards to the feeding hole 62 on the barrel 61 of the empty spool 52 when the feeding hole 62 is positioned at the necessary location to receive the free end of the filament. After the free end of the filament is attached to the empty spool 52, the filament feeding unit 70 traverses horizontally in the lengthwise direction L during the winding process to lay the filament on the barrel 61 between the flanges 63 of the spool 52. The filament feeding unit 70 may further comprise a filament cutting knife (not shown) for automatically cutting the filament after the winding process is complete to separate a cut end of the filament from the wound spool 52'.

Figure 9:
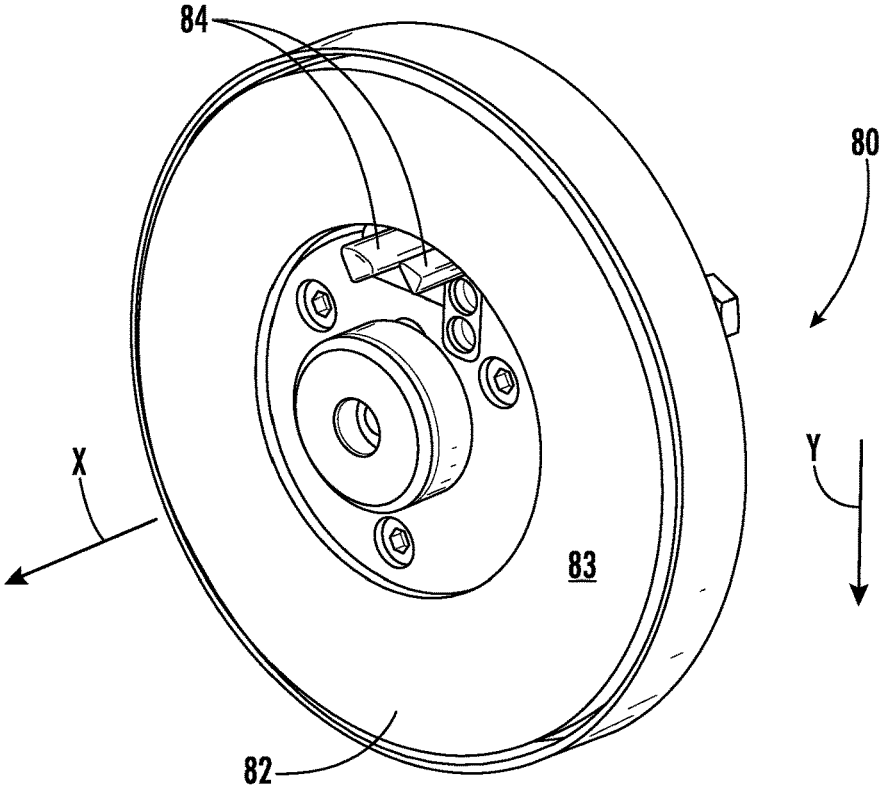
FIG. 9 is a detail perspective view showing a spooling unit of the automated filament spooler of FIG. 2 having a spool drive flange and a filament end attachment clamp.
Figure 10:
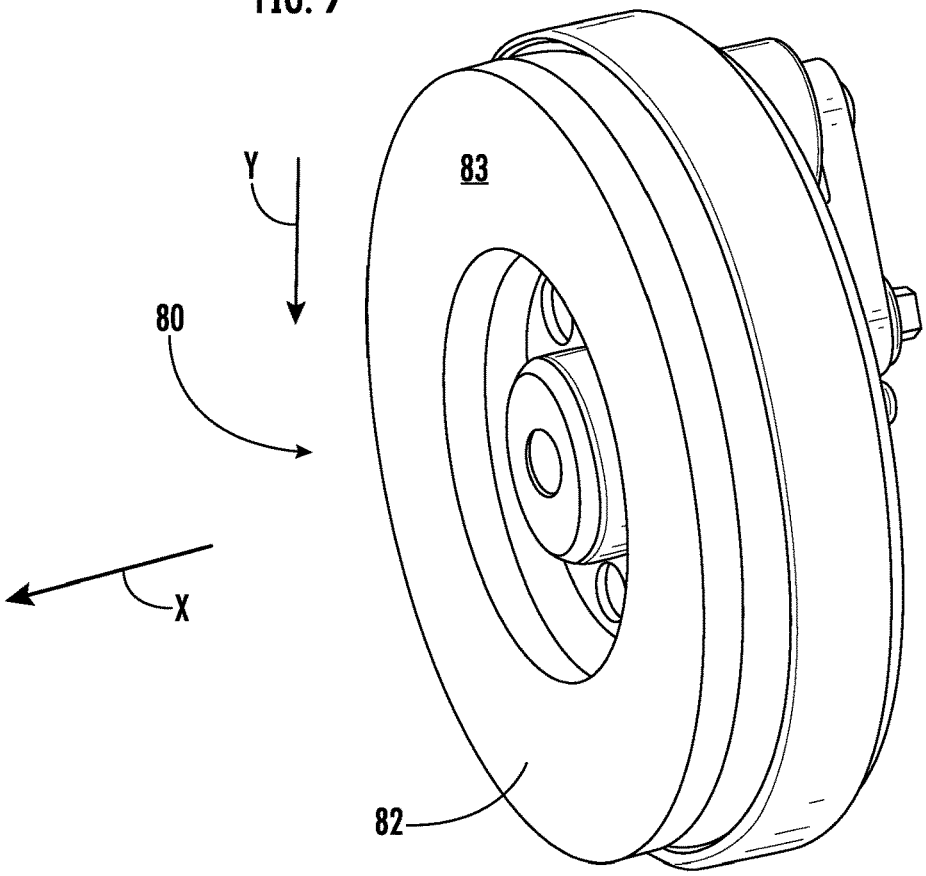
FIG. 10 is a detail perspective view showing the spool drive flange of the spooling head of FIG. 9.

FIG. 7 illustrates an empty spool 52 that has been indexed by the indexing unit 60 such that the feeding hole 62 is positioned at the location necessary to receive the free end of the filament, and has been loaded onto a spooling head (not shown for purposes of clarity, but see FIGS. 9-10). The filament feeding unit 70 is disposed above the empty spool 52 in a ready position for attaching the free end of the filament to the empty spool 52. FIG. 8 illustrates a filament feeder 72 of the unit 70 moved downwardly in a vertical direction Y from a retracted position shown in FIG. 7 to the extended position shown in FIG. 8. A cam plate 74 and associated cam 75 guide and position a feeding tube 76 above the feeding hole 62 provided on the barrel 61 of the empty spool 52. The feeding tube 76 is operable for feeding (i.e. pushing) the free end of the filament into the barrel 61 of the empty spool 52 through the feeding hole 62.

FIGS. 9-10 show an exemplary embodiment of a spooling unit 80 of the automated filament spooler 50. As shown in FIG. 9, the spooling unit 80 comprises a spool drive flange 82 of a spooling head and a filament end attachment clamp 84. The spooling unit 80 is configured and operable for driving (i.e. rotating) the spool drive flange 82 of the spooling head, and therefore, the spool 52 during the winding process to accumulate the filament on the barrel 61 between the flanges 63 of the spool 52. The filament end attachment clamp 84 is configured and operable for gripping the free end of the filament fed through the feeding hole 62 within the barrel 61 of the spool 52 during the winding process to retain the filament on the spool 52. As depicted herein, the filament end attachment clamp 84 comprises a pair of pins that are disposed inside the barrel 61 of the spool 52 on either side of the feeding hole 62 such that one pin is located on a first side of the feeding hole 62, while the other pin is located on a second side of the feeding hole 62 opposite the first side. After the free end of the filament is fed (i.e. pushed) through the feeding hole 62, as illustrated in FIG. 8, the pair of pins of the filament end attachment clamp 84 close together and thereby grip the free end of the filament within the barrel 61 of the spool 52.

FIG. 10 shows the spool drive flange 82 on the spooling head of the spooling unit 80 that is operable for transferring rotational movement to the spool 52 during the winding process. In a preferred embodiment, the spool drive flange 82 has a covering 83 that provides increased or enhanced friction between the spool drive flange 82 and the spool 52 during the winding process. The covering 83 may, by way of example and not limitation, be formed of an elastic material, such as rubber, hardened foam or the like. Regardless, spool drive flange 82 is movable in the axial direction X and biased by a biasing element, for example a spring load. When the empty spool 52 is loaded into the spooling unit 80, the outer flange 63 of the spool 52 presses against the movable spool drive flange 82 and the biasing element is compressed behind the spool drive flange 82. As a result, the pair of pins of the filament end attachment clamp 84 protrudes outwardly in the axial direction X from the spool drive flange 82 so as to be in position to grip the free end of the filament within the barrel 61 of the spool 52. The force exerted by the biasing element of the spool drive flange 82 serves to push the wound spool 52' off the pins of the filament end attachment clamp 84 so that the wound spool 52' is free to move downwardly in the vertical direction Y onto the conveyor 54 to be conveyed from the enclosure 56 of the automated filament spooler 50.

Figure 12:
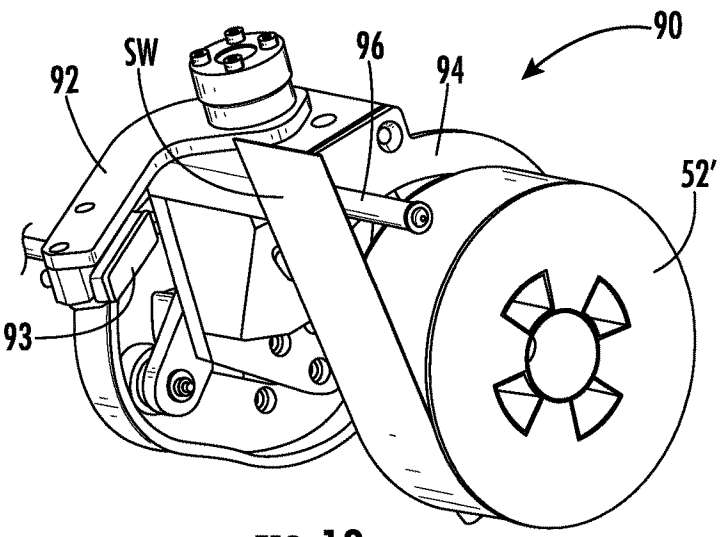
FIG. 12 is a detail perspective view showing the stretch wrap applicator of FIG. 11 in an opened position.
Figure 13:
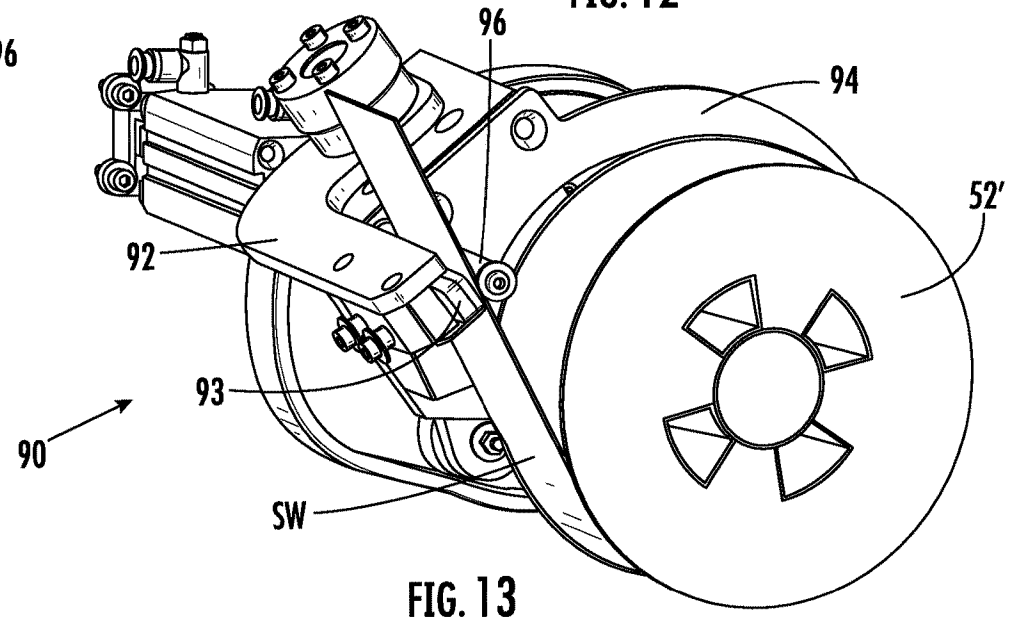
FIG. 13 is a detail perspective view showing the stretch wrap applicator of FIG. 11 in a closed position.
Figure 11:
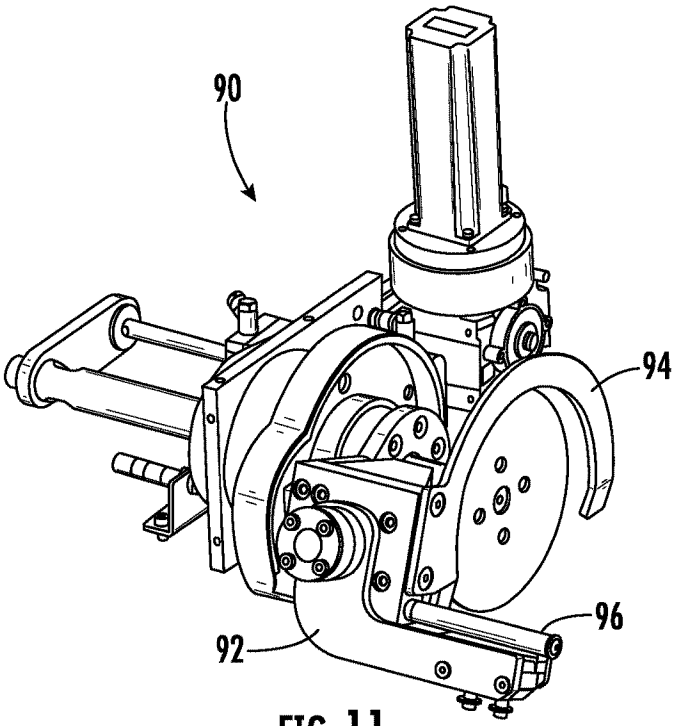
FIG. 11 is a detail perspective view showing an optional packaging unit, commonly referred to as a stretch wrap applicator, of the automated filament spooler of FIG. 2.

FIGS. 11-13 show an exemplary embodiment of an optional packaging unit 90 of the automated filament spooler 50. The packaging unit 90, commonly referred to as a stretch wrap applicator, is configured and operable for packaging a wound spool 52' of the filament in a known manner. The stretch wrap applicator 90 is essentially a clamping device comprising a movable (i.e. rotatable) clamp 92 having a cutting blade 94. The clamp 92 rotates around the wound spool 52' to cover the wound spool 52' with a first layer of a packaging material, such as conventional stretch wrap SW. Additional layers of the stretch wrap SW are applied onto the wound spool 52' by rotating the wound spool 52' on the automated filament spooler 50. While the first layer of the stretch wrap SW is applied to the wound spool 52', the clamp 92 is closed for about 290 degrees of the first revolution. The clamp 92 must then be opened to release the end of the stretch wrap SW that will be wound underneath the next layer of the stretch wrap SW. Typically, movement of the clamp 92 between the closed and opened is accomplished using a pneumatic cylinder. However, such movement is complicated on the automated filament spooler 50 of the present invention since the stretch wrap applicator 90 is necessarily mounted on a rotating part of the spooler 50. Consequently, there is a need for a pneumatic air swivel.

The stretch wrap applicator 90 of automated filament spooler 50 comprises a cam plate 94 having a cam profile that controls when the clamp 92 will be opened or closed. FIG. 12 shows the stretch wrap applicator 90 with the clamp 92 opened by the cam profile of the cam plate 94. In the configuration shown in FIG. 12, the stretch wrap applicator 90 is configured to be ready to cut and clamp the stretch wrap SW. FIG. 13 shows the stretch wrap applicator 90 with the clamp 92 rotated further from the opened position shown in FIG. 12 to a closed position. A clamp plate 93 of the clamp 92 is pressed against a stop 96 with the stretch wrap SW disposed between the clamp plate 93 and the stop 96. In a preferred embodiment, the clamp plate 93 has a covering formed from an elastic material, such as rubber or hardened foam, and the stop 96 is in the form of an elongate, cylindrical rod. Regardless, a knife (not shown) underneath the clamp 92 is pressed against the stretch wrap SW disposed between the stop 96 and the clamp plate 93 to cut the stretch wrap SW.

The foregoing detailed description in conjunction with the accompanying drawing figures has described one or more exemplary embodiments of an automated filament spooler for winding and packaging 3D printing filament used in 3D printing. In exemplary embodiments, the automated filament spooler includes an indexing unit configured and operable for positioning a feeding hole of an empty spool at a location necessary for feeding a free end of a filament onto the spool. The automated filament spooler further includes a filament feeding unit configured and operable for feeding the free end of the filament onto the spool. The automated filament spooler further includes a spooling head having a biased spool drive flange and a movable filament end attachment clamp configured and operable for gripping the free end of the filament on the empty spool. The automated filament spooler further includes an optional stretch wrap unit (e.g. applicator) configured and operable for applying a packaging material, such as stretch wrap, onto a wound spool. While exemplary embodiments of the invention have been described and shown in the accompanying drawing figures, those of ordinary skill in the art will readily acknowledge and appreciate that the apparatus, systems and methods of the present invention(s) may be embodied in numerous other forms and manners without departing from the broad intended scope of this disclosure. Accordingly, it is to be understood that the appended claims are to be interpreted given their broadest reasonable interpretation consistent with the forgoing written description and accompanying drawings.

That which is claimed is:

1. An automated filament spooler for automatically winding a filament on a spool, comprising:

an enclosure;

a conveyor for conveying an empty spool into the enclosure and for conveying a wound spool from the enclosure;

an indexing unit configured and operable for automatically positioning a feeding hole provided on the spool at a location necessary for feeding a free end of the filament onto the spool;

a filament feeding unit configured and operable for automatically feeding the free end of the filament through the feeding hole of the spool; and a spooling unit configured and operable for automatically gripping the free end of the filament and for rotating the spool to wind the filament onto the spool.

2. The automated filament spooling according to claim 1, wherein the indexing unit comprises at least one roller for rotating the spool on the indexing unit.

3. The automated filament spooler according to claim 2, wherein the at least one roller has at least one groove for receiving an outer flange of the spool.

4. The automated filament spooler according to claim 1, wherein the filament feeding unit is disposed above the indexing unit with the feeding hole positioned at the location necessary for feeding the free end of the filament onto the spool.

5. The automated filament spooler according to claim 4, wherein the filament feeding unit comprises a filament feeder that is moved downwardly in a vertical direction from a retracted position to an extended position for feeding the free end of the filament onto the spool.

6. The automated filament spooler according to claim 5, wherein the filament feeder comprises a cam plate and an associated cam that guide and position a feeding tube above the feeding hole provided on the spool.

7. The automated filament spooler according to claim 6, wherein the feeding tube is operable for feeding the free end of the filament into a barrel of the spool through the feeding hole.

8. The automated filament spooler according to claim 1, wherein the spooling unit comprises a filament end attachment clamp configured and operable for gripping the free end of the filament within a barrel of the spool during a winding process to retain the filament on the spool.

9. The automated filament spooler according to claim 8, wherein the filament end attachment clamp comprises a pair of pins disposed inside the barrel of the spool that close together to thereby grip the free end of the filament within the barrel of the spool.

10. The automated filament spooler according to claim 8, wherein the spooling unit further comprises a spool drive flange that is operable for transferring rotational movement to the spool during a winding process.

11. The automated filament spooler according to claim 10, wherein the spool drive flange has a covering that provides increased friction between the spool drive flange and the spool during the winding process.

12. The automated filament spooler according to claim 10, wherein the spool drive flange is movable in an axial direction and biased by a biasing element such that when the spool is loaded into the spooling unit an outer flange of the spool presses against the spool drive flange and the biasing element is compressed behind the spool drive flange.

13. The automated filament spooler according to claim 12, wherein the filament end attachment clamp protrudes outwardly in the axial direction from the spool drive flange to grip the free end of the filament within the barrel of the spool, and wherein a biasing force exerted by the biasing element of the spool drive flange serves to push the spool off the filament end attachment clamp in the axial direction so that the spool is free to move downwardly in a vertical direction onto the conveyor to be conveyed from the enclosure.

14. The automated filament spooler according to claim 1, further comprising a packaging unit configured and operable for packaging a spool of the filament.

15. The automated filament spooler according to claim 14, wherein the packaging unit is a stretch wrap applicator comprising a clamp having a cutting blade that is movable between an opened position and a closed position, and wherein the clamp rotates around the spool to cover the spool with a first layer of a stretch wrap.

16. The automated filament spooler according to claim 15, wherein the stretch wrap applicator comprises a cam plate having a cam profile that controls when the clamp is in the opened position and the closed position such that a clamp plate of the clamp is pressed against a stop with the stretch wrap disposed between the clamp plate and the stop.

17. A method for automatically winding a filament onto a spool, comprising:

conveying the spool into an enclosure of an automated filament spooler;

using an indexing unit to rotate the spool to automatically position a feeding hole provided on the spool at a location necessary for feeding the filament onto the spool;

automatically feeding a free end of the filament onto the spool through the feeding hole provided on the spool;

automatically gripping the free end of the filament fed through the feeding hole provided on the spool; and using a separate spooling unit to rotate the spool to wind a length of the filament onto the spool.

18. The method according to claim 17, further comprising automatically cutting the length of the filament wound onto the spool.

19. The method according to claim 17, further comprising automatically packaging the spool with a shrink wrap.

20. The method according to claim 17, wherein positioning the feeding hole provided on the spool comprises rotating the spool on at least one roller having at least one groove for receiving an outer flange of the spool to limit a movement of the spool in an axial direction.

* * * * *